US006234347B1

(12) United States Patent
Amron

(10) Patent No.: US 6,234,347 B1
(45) **Date of Patent: *May 22, 2001**

(54) PRESSURIZED WATER GUN WITH SELECTIVE PRESSURIZATION

(75) Inventor: Alan Amron, Syosset, NY (US)

(73) Assignee: Amron Development, Inc., Woodbury, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/340,810

(22) Filed: Jun. 28, 1999

Related U.S. Application Data

(63) Continuation-in-part of application No. 08/500,240, filed on Jul. 10, 1995, now Pat. No. 5,915,771.

(51) Int. Cl.[7] ..... G01F 11/00
(52) U.S. Cl. ..... 222/1; 222/79; 222/401
(58) Field of Search ..... 222/1, 79, 401; 446/405, 473

(56) References Cited

U.S. PATENT DOCUMENTS

| | | | |
|---|---|---|---|
| 3,197,070 | | 7/1965 | Pearl . |
| 4,135,559 | | 1/1979 | Barnby . |
| 4,214,674 | | 7/1980 | Jones et al. . |
| 4,257,460 | | 3/1981 | Paranay et al. . |
| 4,735,239 | | 4/1988 | Salmon et al. . |
| 4,854,480 | | 8/1989 | Shindo . |
| 4,867,208 | | 9/1989 | Fitzgerald . |
| 5,064,095 | | 11/1991 | Camerino . |
| 5,074,437 | * | 12/1991 | D'Andrade et al. ..... 222/79 |
| 5,150,819 | | 9/1992 | Johnson et al. . |
| 5,174,477 | | 12/1992 | Schafer . |
| 5,284,300 | | 2/1994 | Gries et al. . |
| 5,292,032 | | 3/1994 | Johnson et al. . |
| 5,305,919 | | 4/1994 | Johnson et al. . |
| 5,366,108 | * | 11/1994 | Darling ..... 222/79 |
| 5,373,975 | | 12/1994 | Husted . |
| 5,531,627 | | 7/1996 | Deal . |
| 5,595,325 | | 1/1997 | Leres . |
| 5,915,771 | * | 6/1999 | Amron ..... 222/79 |

* cited by examiner

*Primary Examiner*—Joseph A. Kaufman
(74) *Attorney, Agent, or Firm*—Brian K. Dinicola

(57) ABSTRACT

A toy water gun operable in accordance with two distinct modes of operation. In a first mode of operation, the toy water gun receives and stores pressurized water directly from a municipal water supply. This is achieved using an adapter which allows water to flow under pressure into a reservoir of the gun such that the user need only depress a trigger to cause water to eject through the nozzle of the gun. In a second mode of operation, a fill cap or other opening is exposed so that unpressurized water may be poured in or otherwise received into the gun. A manually operable pump is included so that the unpressurized water may be pressurized whereupon depression of the trigger will cause the water to be ejected from the gun.

24 Claims, 4 Drawing Sheets

PRESSURIZED WATER GUN WITH SELECTIVE PRESSURIZATION

REFERENCE TO RELATED APPLICATIONS

This application is a continuation in part of U.S. patent application Ser. No. 08/500,240 filed on Jul. 10, 1995 and entitled "Pressurized Water Gun With Selective Pressurization."

FIELD OF THE INVENTION

The present invention relates generally to toy water gun systems having a pressurized receptacle and, more particularly, to guns employing a receptacle that is at least partially pressurized by a municipal water supply.

BACKGROUND OF THE INVENTION

Water guns have for decades been a very popular child's toy. The toy industry is very competitive, hundreds of different style water guns have been developed in an attempt to profit from the toy's inherent popularity. The most traditional forms of water guns are activated by a pumping action, either manually through the trigger or automatically through a battery operated motor. Because the range and volume of water expelled in such water pistols is limited by the throw of the pistol trigger, relatively sophisticated water guns have been introduced for expanding both the range of water guns and the volume of the water streams the water guns can produce. Typically, these guns work upon the principle of pressure differentials between the water held within the toy and the atmosphere. The water within the toy is subjected to a pressure higher than that of the ambient air. As a result, when the water within the toy is given an avenue of escape, the water will stream out under the pressure.

Prior art that shows pressure differential types of water guns are exemplified by U.S. Pat. No. 3,197,070 to Curtis F. Pearl et al., which shows a water gun activated by trapping water in a collapsible area. As the device is collapsed, the pressure of the water builds, spraying the water out of the one small orifice left within the pressurized volume. Once the confined volume is fully collapsed, the re-expansion of the volume draws forth more water from a reservoir, thus priming the water gun for another cycle. The water being pressurized is limited to the volume of the collapsible volume. The Pearl '070 invention cannot store pressurized water for use at a later time, nor can the pressure of the water be increased by cycling the pumping action of the invention while restraining water discharge.

U.S. Pat. No. 4,854,480 to Robert S. Shindo and U.S. Pat. No. 4,735,239 to Michael E. Salmon et al, both show toy water devices that use an elastic bladder to pressurize water. The bladders are filled with high pressure water, and the bladders respond by elastically deforming. The source of pressurized water is then removed and the water within the expanded bladder is held in place by a clamping device activated by a trigger. The water gun is used by selectively releasing the clamp, allowing the water to flow from the expanded bladder.

Water guns have also been developed that use air pressure to pressurize water and force water through squirt channels. Such toys that use air pumps to pressurize water are exemplified by U.S. Pat. No. 4,214,674 to Jones et al, which shows a two-piece apparatus consisting of a pressurized water reservoir and a discharging gun. Air is introduced into the water reservoir via a hand operated pump. The air pressurizes the water, forcing it up through the discharging gun, where the rate of discharge can be regulated by a trigger. U.S. Pat. No. 5,074,437 to D'Andrade et al. also discloses a water gun that pressurizes water by establishing fluid communication between a water reservoir and an air reservoir, and providing means for pressurizing the air reservoir to expel water from the gun when the gun's trigger is pulled.

While pressurized water guns equipped with a hand operated pump, in particular, have enjoyed considerable commercial success, the need to repeatedly operate the pumping mechanism, often twenty five times or more, to achieve adequate air pressurization within the reservoir, presents a challenge to the impatient user. Recognizing this deficiency, it has been proposed by Darling, in U.S. Pat. No. 5,366,108, to omit the air pressurizing mechanism in favor of a one-way valve so that a source of previously pressurized water, i.e., a municipal water supply, may be used to charge a receptacle that contains trapped air. While the Darling device advantageously enables the user to simultaneously combine the water charging and pressurizing steps, however, it is only useful where access to a municipal water supply is readily available. Accordingly, after the initial supply of pressurized water is exhausted, it can not be used at such locations as the beach, the playground, or like.

SUMMARY OF THE INVENTION

Accordingly, it is an object of the present invention to provide a pressurized water gun device which is capable of advantageously utilizing a municipal water supply to pressurize a fluid stored in the receptacle thereof, when such a source of water is available.

It is a further object of the present invention to provide a pressurized water gun device that enables the user to utilize a non-pressurized source of water, when such source is the only one available.

It is yet another object of the present invention to provide an adaptor assembly by which any commercially available air pump-type water gun may be modified to obtain the aforementioned capabilities.

The aforementioned objects, as well as others which will become apparent to those skilled in the art from the teachings set forth herein, are achieved by a water gun which utilizes an interface or adaptor assembly that includes a one-way valve to selectively charge a water reservoir tank with pressurized water from a municipal water supply.

A water gun constructed in accordance with an illustrative embodiment of the present invention comprises a housing and an extended handle connected to the housing. A barrel portion of the housing extends outwardly away from the handle. The water gun further comprises a nozzle having an orifice therethrough, the nozzle being affixed to the end of the barrel portion, and a high pressure, water storage reservoir having an orifice. An avenue of release connects the nozzle to the water storage reservoir, and a trigger is located on the housing adjacent the handle. A controlling means connected to the avenue of release regulates the flow of water and air through the avenue of release and a one-way valve assembly selectively establishes fluid communication between an external, pressurized water source and the water storage reservoir.

Since it is contemplated that a supply of pressurized water will not always be available, the water gun of the present invention further includes a pressuring means with a slider, for pressurizing the water storage reservoir with air. The pressurizing means is preferably configured as an integral part of the water gun housing.

BRIEF DESCRIPTION OF THE DRAWINGS

The details of the present invention, both as to its construction and operation can best be understood with reference to the accompanying drawings, in which like numerals refer to like parts, and in which.

DETAILED DESCRIPTION OF THE PRESENTLY PREFERRED EMBODIMENTS

Figure 1:
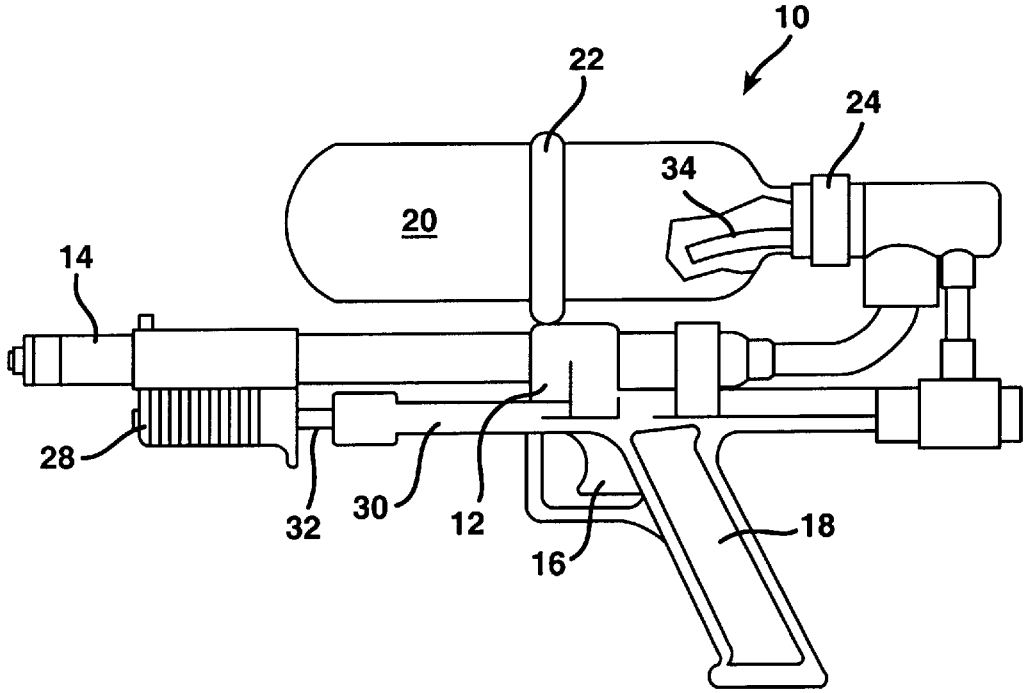
FIG. 1 PRIOR ART
FIG. 1 is a side elevation view depicting a conventional pressurized water gun.

Referring now to FIG. 1, there is shown a conventional water gun indicated generally at reference numeral 10. Throughout the several views, like elements are represented by like reference numerals. Essentially, the water gun depicted in FIG. 1 is described in U.S. Pat. No. 5,074,437, issued on Dec. 24, 1991 to D'Andrade, et al and entitled PINCH TRIGGER PUMP WATER GUN, which application is expressly incorporated herein by reference in its entirety. It will, however, be readily ascertained by those skilled in the art that the teachings of the present invention are equally applicable to any water gun apparatus utilizing a pressurized receptacle and that the particular configuration depicted in FIG. 1 is for illustrative purposes only.

In any event, and with continued reference to FIG. 1, it can be seen that conventional water gun 10 includes a main housing 12 with an extending barrel 14, trigger 16, and handle 18. The detachable water reservoir 20 is held to the main housing 12 via an attachment collar 22 and reservoir mount 24. In the illustrative prior art apparatus of FIG. 1, the air pump (not shown) is embodied within the main housing 12 but the handle to the pump is attached to the slider handle 28 that travels along, and is guided by the water gun barrel 14.

As is described in the above-identified patent, the water reservoir 20 is cylindrical and has a threaded orifice (not shown). To fill the water reservoir 20 with water, the water reservoir must be detached from correspondingly threaded reservoir mount 24 by unscrewing the threaded orifice therefrom. Water may then be placed into the reservoir 20 and the water reservoir 20 is rethreaded into position shown in FIG. 1. Once filled with water, the water gun 10 is operated by pressurizing the water reservoir 13 with air.

Air is forced into the reservoir by the relative movement of a piston (not shown) within air pump shaft 30. The piston is operated by a pump rod 32 that connects the piston to the slider handle 28. A user holds the slider handle 28 with one hand and the gun handle 18 with the other. The slider handle 28 is then moved back and forth manually along the length of the barrel 14. The back and forth action is transferred to the piston, which forces air past a one way flow valve, through a length of air flow tubing, through a water backflow prevention flap (none of which are shown) and into the water reservoir 20. Air is continuously added to the water reservoir 20 until a desired pressure is reached. Water is discharged, upon depression of trigger 16, via tube 34 which tube extends into reservoir 20.

Figure 2A:
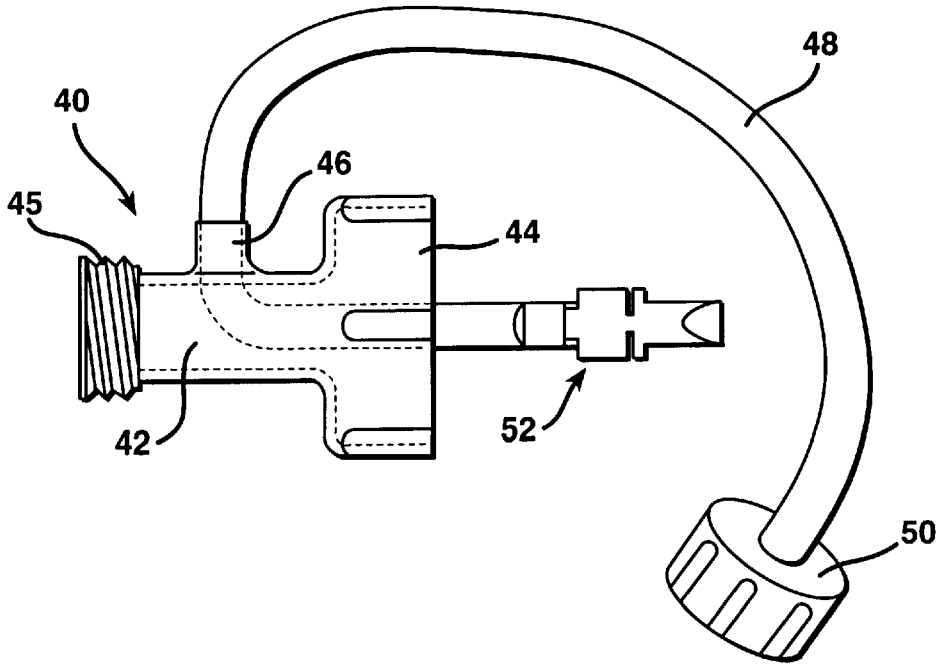
FIGS. 2A through 2C are perspective views of adapter assemblies constructed in accordance with representative embodiments of the present invention.

As will be readily appreciated by those skilled in the art, this configuration enables the user to charge the reservoir with water from any available source such, for example, as a water fountain, swimming pool, stream or pond, or municipal water supply. However, the effort required to adequately pressurize the same is quite considerable and may take several minutes to achieve the desired level, even when a source of pressurized water is already available. Accordingly, a water gun constructed in accordance with the present invention utilizes an adaptor which acts as an interface for establishing fluid communication between the source of pressurized water, e.g. a municipal water supply, and water reservoir 20. An illustrative embodiment of an adaptor assembly 40 constructed in accordance with the present invention is depicted in FIG. 2A.

Adaptor assembly 40 comprises a tubular member 42 having a first open end 44 configured for sealing engagement with the neck of water reservoir 20 and a second open end 45 configured for sealing engagement with reservoir mount 34. In the illustrative embodiment of FIG. 2, first open end 44 comprises a female fitting having interior threads for complementary engagement with the exterior threads on the neck of reservoir 20 while the second open end 45 comprises a male fitting having exterior threads for complementary engagement with the interior threads within the bore or reservoir mount 34. It will, of course, be readily appreciated that open ends of tubular member 42 may be readily modified as needed to provide a sealed interface between the reservoir and reservoir mount and that the precise configuration thereof will necessarily depend upon the external and internal shape of each. Thus, by way of additional illustrative examples, the threads may be reversed, or if desired, compression fittings may be utilized at one or both ends of tubular member 42.

Figure 2B:
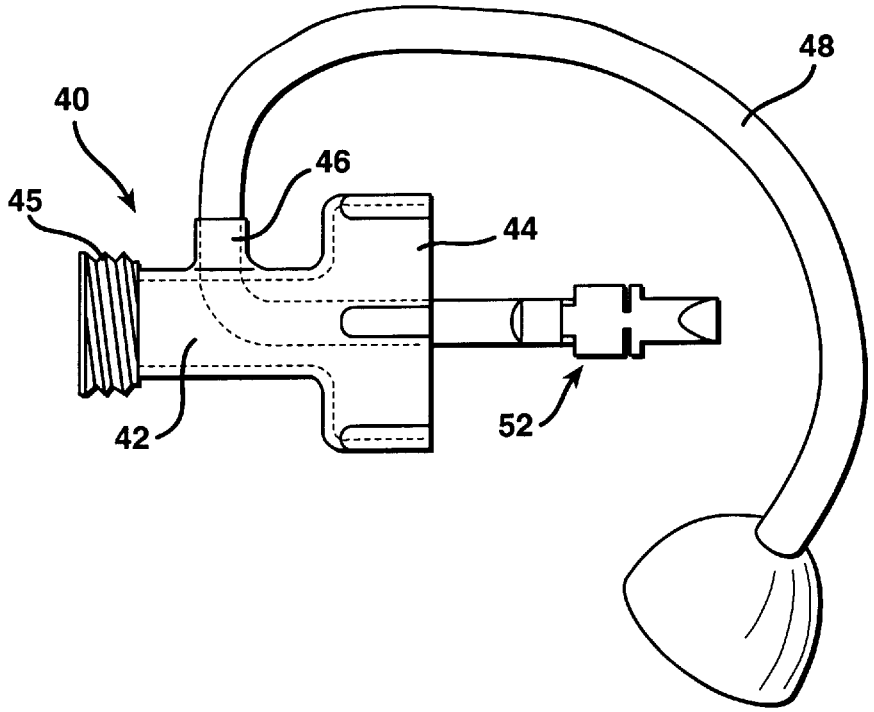
Figure 2C:
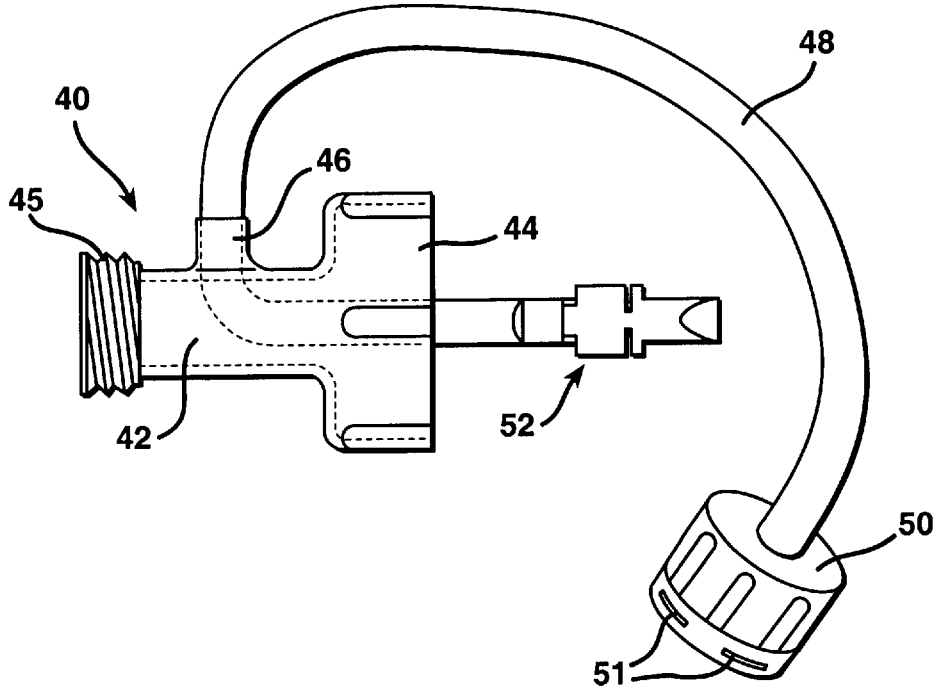

Adapter assembly 40 further includes a radially extending bore or port 46 formed in the wall of the tubular member 42 to accommodate the passage of a flexible connecting tube or hose 48 therethrough. A first end of tube 48 is connected to a fitting or coupling 50 configured for sealing engagement with a outlet for municipally supplied water such, for example, as an outdoor or indoor faucet, garden hose, or the like. Illustratively, coupling 50 may comprise a conventional threaded female hose fitting. In this regard, however, it should be noted that any fitting suitable for establishing sealed, fluid communication with a pressurized, municipal water supply may be employed for the purposes of the present invention and that the specific type of fitting used is not deemed to be a novel aspect of the present invention. By way of further example, an elastomeric tube with a graduating lip capable of stretching so as to tightly, snuggly, and quickly fit over most any hose, hose spigot or sink faucet may instead be utilized. The inventor herein has recently appreciated that when used in conjunction with an aerating faucet fitting (not shown) of the type used in many kitchens and bathrooms, such a configuration markedly enhances the pressurization by simultaneously introducing both water and air into the receptacle. An exemplary configuration is shown in FIG. 2B. This same principle may advantageously be extended to faucets not so equipped by incorporating an aerating element 51 in the body of the adapter supply fitting 50, as shown in FIG. 2C.

Figure 3:
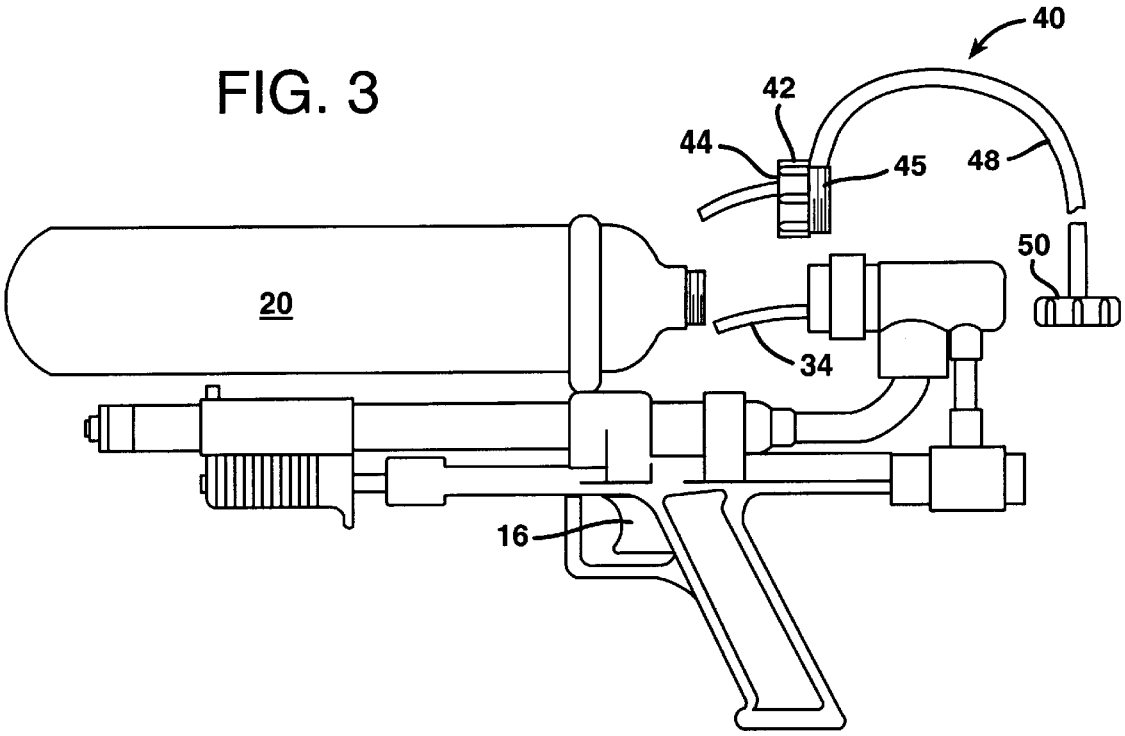
FIG. 3 is an exploded side elevation view depicting the modification of an existing pressurized water gun utilizing the inventive adaptor assembly of FIG. 2A.
Figure 4:
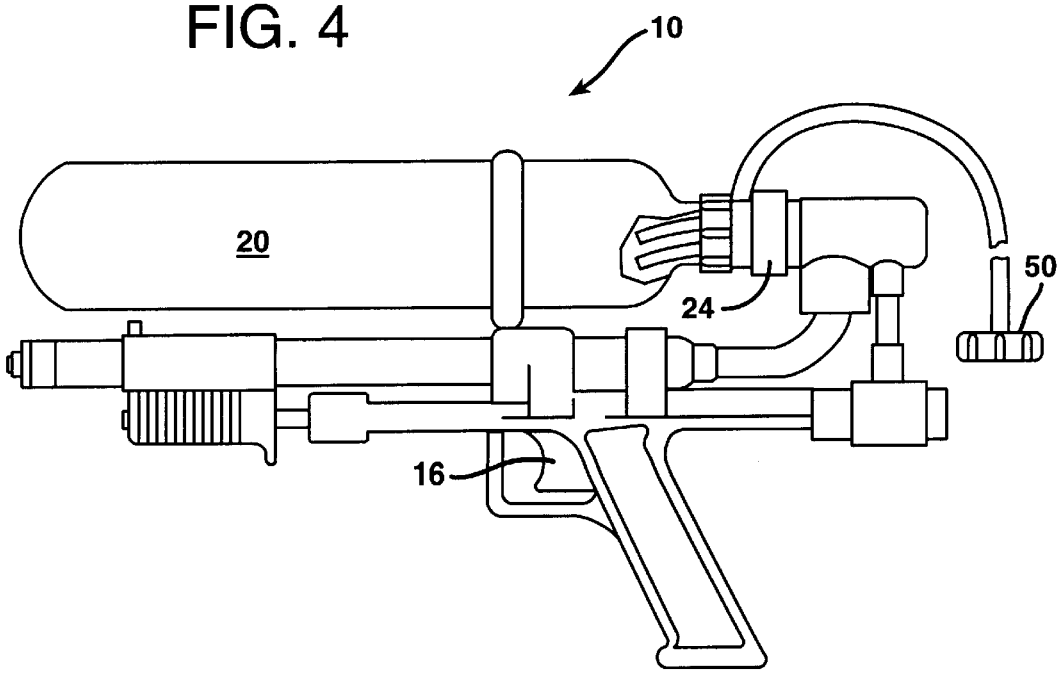
FIG. 4 is a side elevation view of a water gun constructed in accordance with an illustrative embodiment of the present invention.
Figure 5:
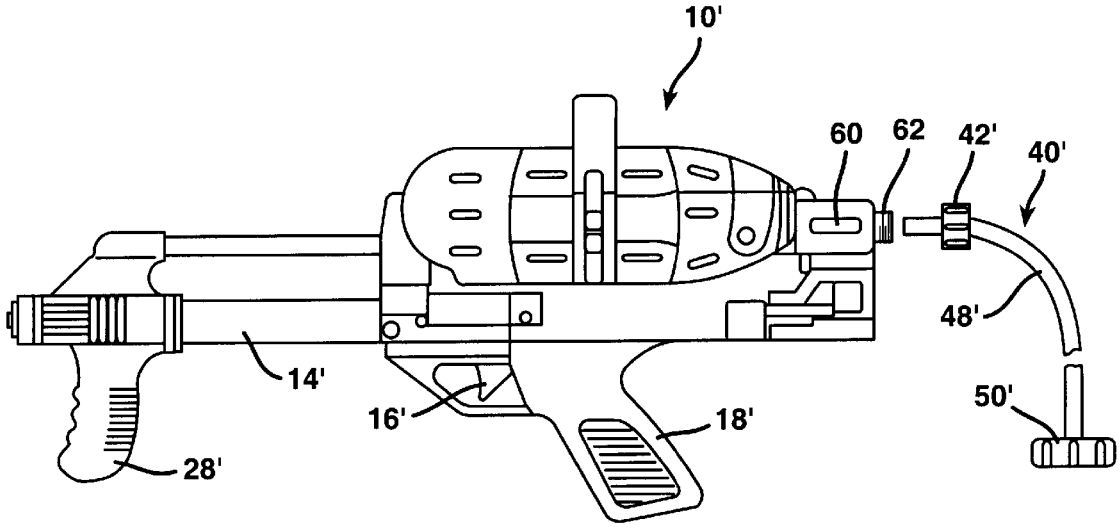
FIG. 5 is an exploded side elevation view depicting the modification of an existing pressurized water gun utilizing an adaptor assembly constructed in accordance with an alternate embodiment of the present invention.

In any event, and returning now to FIG. 2A, it will be observed that a second end of tube 48 is connected to a one-way valve assembly 52, such that pressurized water available from a municipal water supply may be introduced into tube 48 and thereafter into reservoir 20, when coupled therebetween in the manner shown in FIGS. 3 and 4. The one-way valve 52 may be any conventional one-way or check valve, such as a ball or flap valve or the like, which will permit the liquid to flow freely in one direction and which prevents the liquid from flowing in the opposite direction. The longitudinal bore of tubular member 40 is also dimensioned to accommodate the insertion of delivery tube 34, by which water is removed from reservoir 20 when the trigger 16 is depressed.

The operation of a water gun constructed in accordance with the embodiment of FIGS. 2–4 will now be described in detail. Hose fitting 50 is fitted on a hose bib (not shown) supplying pressurized water provided by a municipal water supply. The pressurized water is allowed to flow past a check valve into receptacle 20 which pressurizes the trapped air. When the pressure in the receptacle 20 equals the pressure of the municipal water supply, flow will stop. Hose fitting 50 can then be disconnected from the hose bib and the toy water gun system shown is ready for operation. If desired, additional pressure can be added manually using sliding handle 28.

Of course, if a source of municipal water is not available, the reservoir employed by the water gun of the present invention is instead charged in the usual manner by unscrewing the reservoir from adaptor assembly 40 and filling it either by immersing it in a body of water or filling it with a stream of water from a water fountain or the like.

As suggested in FIG, 3, the adaptor assembly 40 of the present invention may those configured as a discrete component for use in modifying an existing water gun such as those of the type disclosed in U.S. Pat. No. 5,074,437. The adaptor assembly utilized in the complete system shown in FIG. 4, however, may alternatively be formed as an integral part of reservoir mount 24, thus obviating the need for an attachment between the latter and a second end as threaded second end 46.

It is also contemplated that the use of a discrete adaptor assembly in accordance with the present invention may be extended to a variety of other water gun configurations utilizing a pressurizing receptacle. Thus, for example, in FIG. 6 there is shown an adaptor assembly 40' modified to accommodate a water gun system 10' of the type in which the water reservoir 20' is not removable. In this embodiment, the adaptor assembly 40' is adapted to replace the conventional fill plug (not shown) which is screwed over threaded male port 60 of air/water manifold 62. For this purpose, adaptor assembly 40' is configured without a radial bore, with tube 48' being inserted through a port defined at one end of tubular member 42'. The opposite end of tubular member 42' is correspondingly threaded for sealing engagement with port 60 of the air water manifold.

Figure 6:
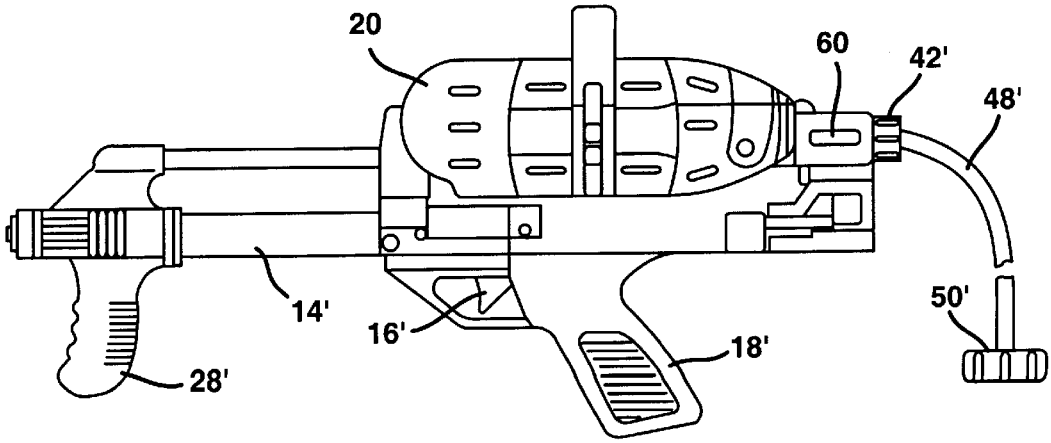
FIG. 6 is a side elevation view of a water gun constructed in accordance with the alternative adapter assembly of FIG. 5.

As in the case with the previously described embodiment, the other end of tube 48' is connected to a conventional one-way valve (not shown) that is introduced into the interior of the air/water manifold 60 or, if desired, into the interior of reservoir 20, when tubular member 42' is screwed onto port 62 in the manner depicted in FIG. 6. As before, it should be noted that the tubular member 42' may alternatively be configured as an integral part of the air/water manifold 60.

Water guns constructed in accordance with the present invention exhibit substantially improved performance characteristics in comparison to such prior art configurations as the one depicted in FIG. 1. For example, the steps of filling the water reservoir and manually operating the pump to achieve an adequate pressure (e.g., 50 psi) typically requires approximately 2–3 minutes with the conventional apparatus of FIG. 1. The inventive embodiments of the present invention depicted in FIGS. 4 and 6, however, may be charged with water and pressurized to 70–90 psi in about 45 seconds. As such, not only is the pressurizing and filling operation substantially faster, but also the pressures which may be achieved utilizing a pressurized municipal water supply in accordance with the present invention are typically at least 20–40 psi higher than can be achieved using the manual pump alone.

The increased pressures afforded by the present invention, in turn, provide several key benefits. Specifically, it is now possible to generate a sustained discharge stream extending a distance easily in excess of 31 feet and lasting for over five to six minutes. Such results are quite spectacular when compared to those afforded by conventional configurations, which are typically limited to a range of 22 feet and a duration of only 55 seconds. In a water fight, the tactical advantages of a water gun capable of outlasting the competition by five minutes are quite obvious, indeed.

While the particular water guns and adaptor assembly as herein shown and described in detail are fully capable of attaining the above-described objects of the invention, it is to be understood that they are the presently preferred embodiments of the present invention and are thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A high pressure air pressurized toy water gun adapted to receive pressurized or unpressurized water, said toy water sun being operable in a first mode to store and pressurize received unpressurized water and in a second mode to store received pressurized water, comprising:

a housing;

an extended handle connected to said housing, a barrel extending outwardly away from said handle;

a trigger located adjacent the handle;

a nozzle having an orifice therethrough, said nozzle being disposed at the end of said barrel;

a high pressure, water storage reservoir having an orifice adapted to have unpressurized water poured therethrough;

an avenue of release connecting said nozzle to said water storage reservoir;

a valve operable to admit fluid from an external, pressurized water source into said water storage reservoir while said high pressure, water storage reservoir is connected to the gun;

a manually operable pump coupled to the housing for pressurizing said water storage reservoir with air when an external pressurized source of water is unavailable or insufficient to adequately pressurize the water storage reservoir; and a flow connection assembly dimensioned and arranged for sealing attachment to an external, pressurized source of water and to the gun whereby flow of pressurized water is directable through the valve and into the reservoir.

2. The toy water gun of claim 1, wherein said valve is a one-way valve.

3. The toy water gun of claim 1, wherein said flow connection assembly includes a threaded female coupling dimensioned and arranged for attachment to a garden hose.

4. The toy water gun of claim 3, where said flow connection assembly further includes a fitting forming a part of said housing.

5. The toy water gun of claim 4, further including a conduit for defining a fluid flow path between said threaded female coupling and said fitting.

6. The toy water gun of claim 5, wherein said conduit is a flexible tube.

7. The toy water gun of claim 5, wherein said valve is disposed within the housing.

8. A method of charging a high pressure, air pressurized toy water gun of the type comprising a housing, an extended handle connected to the housing, a barrel extending outwardly away from the handle, a nozzle having an orifice therethrough affixed to the end of the barrel, a water storage reservoir configured to store pressurized water and having an orifice, an avenue of release connecting the nozzle to the water storage reservoir, and a trigger located adjacent the handle, and a manually operable pump coupled to the housing for pressurizing the water storage reservoir with air when an external pressurized source of water is unavailable or insufficient to adequately pressurize the water storage reservoir, comprising the steps of:

establishing a one-way fluid path between an external, pressurized water source and the water storage reservoir while the water storage reservoir is attached to the housing; and charging the water storage reservoir with water under pressure from the external, pressurized water source; and at other times, charging the water storage reservoir with unpressurized water by pouring the unpressurized water through the orifice.

9. The method of claim 8, further including a step of operating the pump to supplement pressurization of the water storage reservoir by the external pressurized source of water.

10. The method of claim 8, wherein the establishing step comprises attaching a flow connection assembly dimensioned and arranged for sealing attachment to an external, pressurized source of water and to the housing, whereby flow of pressurized water is directed into the reservoir.

11. The method of claim 8, wherein the storage reservoir is charged with pressurized water to a pressure greater than 50 psig.

12. The method of claim 8, further including a step of unscrewing a cap covering the orifice to charge the water storage reservoir with unpressurized water.

13. The toy water gun of claim 8, wherein said charging step further includes drawing air into the reservoir along with said pressurized water.

14. A toy water gun system designed to release pressurized water therefrom in an extended stream, comprising:

a toy water gun including a barrel, a handle, a reservoir dimensioned and arranged to receive and store pressurized water, a manually operable pump for pressurizing said reservoir, and a trigger selectively operable to release water from said reservoir;

wherein said toy water gun defines a fill opening for receiving unpressurized water, said manually operable pump being operable to manually pressurize unpressurized water received through the fill opening prior to operation of said trigger; and wherein said toy water gun system further includes a fluid interface assembly dimensioned and arranged to receive pressurized water from a municipal water supply and to direct received pressurized water into said reservoir prior to operation of said trigger.

15. The toy water gun system of claim 14, wherein said reservoir is detachable to permit filling through said fill opening.

16. The toy water gun system of claim 14, further including a removable threaded cap for covering said fill opening.

17. The toy water gun system of claim 14, wherein said fluid interface assembly includes a threaded fitting dimensioned and arranged for sealing engagement with a supply fitting associated with a municipal supply of pressurized water.

18. A method of operating a toy water gun system, comprising the steps of:

providing a toy water gun including a barrel, a handle, a reservoir dimensioned and arranged to receive and store pressurized water, a manually operable pump for pressurizing the reservoir, and a trigger selectively operable to release water from said reservoir;

in a first mode of operation, filling said reservoir with unpressurized water through a fill opening, operating the manually operable pump to pressurize the received unpressurized water; and operating the trigger to eject a stream of water; and in a second mode of operation, establishing a fluid communication path between the reservoir and a pressurized municipal water source to charge the reservoir with pressurized water, storing the pressurized municipal water received during the establishing step within the reservoir, and operating the trigger to eject a stream of water.

19. A method of operating a toy water gun, comprising the steps of:

in accordance with a first mode of operation, receiving and storing pressurized water in a reservoir, and depressing a trigger to cause pressurized water stored during said receiving and storing step to pass through an avenue of release and be ejected from a nozzle of the toy water gun; and in accordance with a second mode of operation, receiving unpressurized water into a fill opening of the toy water gun;

operating a manually operated pump of the toy water gun to pressurize water received during the unpressurized water receiving step; and depressing the trigger to cause pressurized water pressurized during said operating step to pass through the avenue of release and to be ejected via the nozzle.

20. The method of claim 19, wherein unpressurized water is received into the toy water gun by pouring into the fill opening.

21. The method of claim 19, wherein unpressurized water is received into the toy water gun by submerging the gun in a body of water.

22. A toy water gun system designed to release pressurized water therefrom in an extended stream, comprising:

a toy water gun including a nozzle, a handle, a reservoir, a manually operable pump, and a trigger selectively operable to release water from said reservoir;

wherein one of said toy water gun and said reservoir defines a fill opening for receiving unpressurized water, said manually operable pump being operable, in accordance with a first mode of operation, to manually pressurize unpressurized water received through the fill opening whereby water is ejected through the nozzle upon depression of the trigger; and a fluid adapter defining a fluid passage for directing pressurized water from a municipal water supply into said reservoir whereby water is ejected through the nozzle upon depression of the trigger.

23. A high pressure air pressurized toy water gun adapted to receive pressurized or unpressurized water, said toy water gun being operable in a first mode to store and pressurize received unpressurized water and in a second mode to store received pressurized water, comprising:

a housing;

an extended handle connected to said housing, a barrel extending outwardly away from said handle;

a trigger located adjacent the handle;

a nozzle having an orifice therethrough, said nozzle being disposed at the end of said barrel;

a high pressure, water storage reservoir having an orifice adapted to have unpressurized water poured therethrough;

an avenue of release connecting said nozzle to said water storage reservoir;

a valve operable to admit fluid from an external, pressurized water source into said water storage reservoir while said high pressure, water storage reservoir is connected to the gun;

a manually operable pump coupled to the housing for pressurizing said water storage reservoir with air when an external pressurized source of water is unavailable or insufficient to adequately pressurize the water storage reservoir; and a flow connection assembly dimensioned and arranged for sealing attachment to an external, pressurized source of water and to the reservoir orifice whereby flow of pressurized water is directable through the valve and into the reservoir.

24. A high pressure air pressurized toy water gun adapted to receive pressurized or unpressurized water, said toy water gun being operable in a first mode to store and pressurize received unpressurized water and in a second mode to store received pressurized water, comprising:

a housing;

an extended handle connected to said housing, a barrel extending outwardly away from said handle;

a trigger located adjacent the handle;

a nozzle having an orifice therethrough, said nozzle being disposed at the end of said barrel;

a high pressure, water storage reservoir having an orifice adapted to have unpressurized water poured therethrough;

an avenue of release connecting said nozzle to said water storage reservoir;

a valve operable to admit fluid from an external, pressurized water source into said water storage reservoir while said high pressure, water storage reservoir is connected to the gun;

a manually operable pump coupled to the housing for pressurizing said water storage reservoir with air when an external pressurized source of water is unavailable or insufficient to adequately pressurize the water storage reservoir; and a flow connection assembly dimensioned and arranged for sealing attachment to an external, pressurized source of water and removably attached to the gun whereby flow of pressurized water is directable through the valve and into the reservoir, the flow connection assembly being adapted to be removably attached to other toy water guns.

* * * * *